US011817663B2

(12) United States Patent
Scharkowski et al.

(10) Patent No.: US 11,817,663 B2
(45) Date of Patent: Nov. 14, 2023

(54) METHOD FOR MANUFACTURING AN ELECTRICAL CONTACT PART

(71) Applicant: Auto-Kabel Management GmbH, Hausen (DE)

(72) Inventors: Oliver Scharkowski, Guben (DE); Marie Redder, Ebnat-Kappel (CH)

(73) Assignee: Auto-Kabel Management GmbH, Hausen i.W. (DE)

( * ) Notice: Subject to any disclaimer, the term of this patent is extended or adjusted under 35 U.S.C. 154(b) by 0 days.

(21) Appl. No.: 17/909,961

(22) PCT Filed: Jan. 31, 2021

(86) PCT No.: PCT/EP2021/050535
§ 371 (c)(1),
(2) Date: Sep. 7, 2022

(87) PCT Pub. No.: WO2021/180375
PCT Pub. Date: Sep. 16, 2021

(65) Prior Publication Data

US 2023/0107114 A1 Apr. 6, 2023

(30) Foreign Application Priority Data

Mar. 12, 2020 (DE) ..... 10 2020 1067 42.9

(51) Int. Cl.
*H01R 4/02* (2006.01)
*H01B 1/02* (2006.01)
(Continued)

(52) U.S. Cl.
CPC ..... *H01R 4/029* (2013.01); *H01B 1/02* (2013.01); *H01R 4/58* (2013.01); *H01R 43/0207* (2013.01)

(58) Field of Classification Search
CPC ..... H01R 4/029; H01R 4/58; H01B 1/02
See application file for complete search history.

(56) References Cited

U.S. PATENT DOCUMENTS

2011/0091738 A1* 4/2011 Tachibana ..... H05K 9/0084 428/601
2011/0114363 A1* 5/2011 Schloms ..... H01R 13/03 174/117 F (Continued)

FOREIGN PATENT DOCUMENTS

CN 101025566 A 8/2007
DE 102014006841 A1 11/2015

(Continued)

OTHER PUBLICATIONS

European Patent Office, International Search Report and Written Opinion for PCT application PCT/EP2021/050535 dated Apr. 1, 2021, with English translation of ISR, 13 pages.

(Continued)

*Primary Examiner* — Peter Dungba Vo
*Assistant Examiner* — Jose K Abraham
(74) *Attorney, Agent, or Firm* — Sunstein LLP

(57) ABSTRACT

An electrical contact part comprising, a carrier substrate of a metallic material, a metallic coating applied to the carrier substrate, and a coating barrier material applied to the carrier substrate in a partial area of the carrier substrate, wherein the coating barrier material substantially prevents coating of the carrier substrate in the portion.

7 Claims, 5 Drawing Sheets

(51) Int. Cl.
*H01R 4/58* (2006.01)
*H01R 43/02* (2006.01)

(56) References Cited

U.S. PATENT DOCUMENTS

| | | | | |
|---|---|---|---|---|
| 2013/0040509 | A1* | 2/2013 | Mitose | H01R 4/185 439/877 |
| 2015/0364836 | A1* | 12/2015 | Yagi | B23K 26/082 439/877 |
| 2016/0028177 | A1* | 1/2016 | Nomura | C22C 21/00 428/626 |
| 2016/0156127 | A1* | 6/2016 | Nomura | H01R 13/533 174/84 R |
| 2016/0336662 | A1* | 11/2016 | Ooba | H01R 43/0207 |
| 2016/0359244 | A1* | 12/2016 | Tachibana | H01R 43/04 |
| 2017/0222345 | A1 | 8/2017 | Doren | |
| 2020/0203857 | A1* | 6/2020 | Scharkowski | H01R 43/0207 |

FOREIGN PATENT DOCUMENTS

| | | | | |
|---|---|---|---|---|
| DE | 102014011887 | A1 | 2/2016 | |
| DE | 102014017886 | A1 | 6/2016 | |
| DE | 102016124601 | B3 | 3/2018 | |
| DE | 102016125748 | B3 | 3/2018 | |
| DE | 102017106742 | B3 | 3/2018 | |
| EP | 2298966 | A1 | 3/2011 | |
| KR | 20180001139 | A * | 1/2018 | |
| WO | 2006/111400 | A2 | 10/2006 | |
| WO | 2007/136734 | A1 | 11/2007 | |
| WO | WO-2018177616 | A1 * | 10/2018 | H01R 4/023 |

OTHER PUBLICATIONS

German Patent Office, Office Action issued in application DE 102020106742.9 dated Oct. 29, 2020, 7 pages.

* cited by examiner

METHOD FOR MANUFACTURING AN ELECTRICAL CONTACT PART

CROSS-REFERENCE TO RELATED APPLICATIONS

This application is the national phase entry of international patent application no. PCT/EP2021/050535 filed Jan. 13, 2021 and claims the benefit of German patent application No. 10 2020 106 742.9 filed Mar. 12, 2020, the disclosures of which are incorporated herein by reference in their entirety.

TECHNICAL FIELD

The subject matter relates to an electrical contact part and a method of manufacturing an electrical contact part.

BACKGROUND ART

Bimetallic electrical contact parts are sufficiently known. In particular, bimetallic contact parts are used when connecting noble metals that are different from each other. A contact part can be formed from a first metallic material and a second component to be connected to the contact part can be formed from a second metallic material different from the first metallic material. In particular, the combination of aluminum materials and copper materials is frequently encountered in automotive applications. The contact part and the other component are formed from these two materials, which are different from each other. To prevent contact corrosion at the junction between the components, an area on the contact part is usually metallically coated to enable the transition at the material-to-material junction between the two components to be as homogeneous as possible.

It is known to join two elongated metal sheets along their longitudinal edges, the sheets being formed from different materials. A metallic coating may be provided at the junction between these two sheets to protect the junction from environmental influences. A first conductor may be connected to one end of the contact part and a second conductor may be connected to the second end of the contact part, in which case the connected conductors may be the same with the metallic materials of the two ends.

It is also known to apply a sheet or foil to a flat part, then mask a central area of the applied sheet or foil, coat the contact part, and finally remove the masking. A first conductor can be connected in the area of the removed masking, and a second conductor can be connected in the area of the coating. However, masking and the final removal of the masking is time-consuming and error-prone. Masking is applied only to prevent coating in the area of masking. The masking is usually applied to the contact part in the form of an adhesive tape and removed again after coating.

However, this application and removal of the masking is disadvantageous in terms of production technology, since in particular the removal of the masking cannot always be carried out fully automatically.

Therefore, the subject matter was based on the object of providing an electrical contact part which has a coated and an uncoated area, whereby its manufacture can be fully automated.

SUMMARY OF THE INVENTION

The contact part is first formed from a carrier substrate. The carrier substrate is formed from a metallic material. The carrier substrate is in particular a flat part and can in particular be provided as a sheet or strap in a quasi-continuous process. The carrier substrate is in particular made of an aluminium material or a copper material. A metallic material is either the pure metal or a metallic alloy.

The carrier substrate can be provided as an elongated flat part. Preferably, the carrier substrate has a material thickness between 0.5 mm and 50 mm and a width between 1 cm and 10 cm. The carrier substrate can be provided as a flat conductor. In particular, the carrier substrate can be formed from a soft-annealed aluminium material.

A metallic coating is applied to the carrier substrate for contacting purposes. The coating can be made of a metallic material. This can be, for example, tin plating and/or nickel plating.

Now, in order to achieve that not the entire surface of the carrier substrate is coated with the metallic coating, it is proposed that the carrier substrate is coated in a partial area with a coating barrier material and that this coating barrier material substantially prevents a coating of the carrier substrate in the partial area.

Therein, the coating barrier material is made of a material, which has the effect that the coating process prevents the material of the coating from being applied to the material of the carrier substrate or prevents the material of the coating from being deposited on the material of the carrier substrate or prevents the surface of the carrier substrate from being wetted or enriched with the material of the coating.

During coating, an intermetallic joining zone is formed between the material of the carrier substrate and the material of the coating. The coating barrier material prevents such an intermetallic joining zone from being formed in the partial area between the material of the carrier substrate and the material of the metallic coating. The use of the coating barrier material eliminates the need for masking and subsequent removal of the masking.

For particularly easy application of the coating barrier material, it is proposed that it be a fluid. Such a fluid can be a liquid or a paste medium and preferably has a viscosity between 0.1 mPas and 1000 mPas. As a result, the coating material can be applied to the partial area of the carrier substrate in a quasi-fluid state.

In particular, the carrier substrate can be guided in a continuous motion under an application device for the coating barrier material, and the coating barrier material is continuously applied to the partial area of the carrier substrate. When the carrier substrate is subsequently metal coated, the coating barrier material in the portion where it is applied to the carrier substrate prevents the coating of the carrier substrate from taking place.

According to an embodiment, it is proposed that the coating barrier material is liquid or in paste form. In this regard, it should be noted that the coating barrier material is preferably formed from a single material and not from a combination of materials, such as an adhesive strip formed from a carrier and an adhesive coating.

According to an embodiment, it is proposed that the coating barrier material is hydrophobic. The hydrophobicity prevents the metallic coating from reaching and depositing on the carrier substrate in the partial area in a wet chemical coating process. As a result, the metallic coating in the partial area is prevented by the coating barrier material.

The coating barrier material is bonded to the carrier substrate by means of adhesion or cohesion. In particular, a material bond may be formed between the coating barrier material and the carrier substrate. However, the coating barrier material does not form an intermetallic bond with the material of the carrier substrate. In particular, the coating barrier material is not a metallic material, but a non-metallic material. In particular, the coating barrier material is exclusively on the surface of the carrier substrate and does not penetrate the surface of the carrier substrate. In particular, the coating barrier material is electrically non-conductive.

According to an embodiment, the coating barrier material is an organic material, in particular a lipid. As such, this may in particular be a fat, wax or resin.

According to an embodiment, the coating barrier material is a silicone material or an inorganic material, in particular a lacquer. Such coating barrier materials, whether organic, inorganic or silicone, can be applied to the carrier substrate in liquid or paste form.

To prevent galvanic coating in the area of the coating barrier material, it is proposed that the coating barrier material is electrically non-conductive. Thus, no coating material can be deposited on the substrate in the region of the coating barrier material during electroplating.

As already explained, after the coating barrier material has been applied, the carrier substrate is metallically coated. According to an embodiment, this is done wet-chemically, in particular electroplating. The coating barrier material prevents deposition of the metallic coating material in the wet-chemical coating.

Frequently, the coated contact part is fed to a welding tool and the contact part is welded to a conductor. In this process, one side of the contact part comes into contact with a welding tool and the other side of the contact part serves as a joining area. Preferably, the portion in which the coating barrier material is applied forms a connection portion of the contact part in which the contact part is connected to an electrical conductor. However, it is also suggested that the partial area in which the coating barrier material is applied faces away from the connection area.

If the contact part is a flat part, it has two opposite wide flat surfaces. On one of these surfaces, a connection area is arranged in which an electrical conductor is attached to the contact part, in particular welded. On the opposite side, the partial area in which the coating barrier material is applied is provided. The partial area that is not coated, due to the coating barrier material, thus comes into contact with the welding tool. In ultrasonic welding in particular, this may be the anvil, for example.

Since there is no metallic coating on the contact part in the partial area, the anvil is also not contaminated by the metallic coating of the contact part. During conventional welding of a coated contact part, the anvil comes into direct contact with the coating material. With the mechanical stress of ultrasonic welding and a large number of welding operations, the anvil becomes contaminated/weared with the coating material and must be replaced. If the part that is not coated is in contact with the anvil, this cannot happen, so that the service life of the welding tool is increased.

A bimetallic contact part is manufactured in particular by arranging a thin material on the carrier substrate in a connection area, for example by means of friction welding, roll cladding or the like. This material in the connection area is joined to the carrier substrate by material bonding. At the transition between the material and the carrier substrate, environmental moisture can penetrate into the joint. To prevent this, a coating is proposed for such bimetallic contact parts. Unlike conventional contact parts, in which the connection area is partially masked with an adhesive strap, the subarea in which the coating barrier material is arranged is arranged within the connection area. The partial area is spaced from a transition between the material of the connection area and the material of the carrier substrate. This transition is coated with the metallic coating. The partial area is provided in a central region of the connection area, and this region is excluded from the metallic coating by the coating barrier material.

According to an embodiment, it is proposed that in a connection area, the contact part is materially connected to a metallic conductor. After the metallic coating is applied, the material of the carrier substrate coated with the coating barrier material is located in the sub-region. The coating barrier material can either be vaporized by the action of heat or removed mechanically, and then the metallic conductor can be applied to the bare material of the carrier substrate, in particular welded. Vaporization of the coating barrier material can also be effected during the welding itself, in particular during ultrasonic welding.

According to an embodiment, it is proposed that the partial area in which the coating barrier material is applied is pretreated. In particular, a surface finish, especially a surface roughness can be reduced. Residues, for example unwanted grease, burrs and the like, can also be removed. This can be done, for example, by radiation treatment, in particular by a laser. The surface of the contact part in the subregion in which the coating barrier material is to be applied is thus suitably prepared for the coating barrier material, so that the latter adheres particularly well to the carrier substrate.

As already explained, in order to extend the service life of a joining tool, in particular an ultrasonic welding tool, in particular an anvil, it is proposed that the contact part with the coating barrier material is placed on a joining tool. The joining tool can be in particular an anvil or a sonotrode of an ultrasonic welding tool. The surface of the joining tool can be roughened and thus lie directly on the material of the carrier substrate through the coating material. The side of the carrier substrate opposite the coating barrier material is joined to a component, e.g. a conductor, by material bonding, in particular welded, in particular ultrasonically welded.

According to an embodiment, it is proposed that the carrier substrate is coated in a connection area with a material that is thinner than the carrier substrate. This coating is in particular made of a metallic material that is different from the material of the carrier substrate. If the carrier substrate is aluminium material, the material may be copper material. If the carrier substrate is a copper material, the material may be an aluminium material.

At a transition between the material of the connection area and the carrier substrate, the contact part may be metallically coated with a coating material, in particular nickel-plated or tin-plated. The partial area that is provided with the coating barrier material lies within the applied thin material that forms a connection area. The connection area is not completely coated, in particular in the area where the coating barrier material is applied, the metallic coating is omitted. After metallic coating, the connection area is present without the metallic coating so that a component can be contacted directly thereon.

The coating barrier material can be removed after metallic coating, in particular evaporated.

In order to form the contact part, this can be formed after the metallic coating by chipless forming. In particular, the contact part can be separated from the solid material of the carrier substrate, in particular by means of cutting, for example laser cutting or by means of punching. It is also possible that the carrier substrate is formed, in particular separated out, in a non-cutting or metal-cutting manner before the metallic coating.

Metallic coating then takes place, with the partial area remaining free of metallic coating, since the coating barrier material is applied there.

The carrier substrate can be passed continuously under a nozzle through which the coating barrier material is applied.

Thereby, the coating barrier material can be applied in liquid or paste form in a coating process. After this application, the carrier substrate can be metallically coated, in particular electroplated, in a wet-chemical coating process.

BRIEF DESCRIPTION OF THE DRAWINGS

In the following, the subject matter is explained in more detail with reference to a drawing showing embodiments. In the drawing show.

DETAILED DESCRIPTION OF SPECIFIC EMBODIMENTS

FIG. 1 shows a carrier substrate 2, which is provided as a flat part. The carrier substrate 2 extends along a longitudinal axis X. The carrier substrate 2 has two opposing wide surfaces 2*a* and two opposing narrow surfaces 2*b*, and is thus formed in a cuboid shape. The carrier substrate 2 preferably extends for a greater length in the longitudinal direction X than in any axis transverse to the longitudinal extension X. The carrier substrate 2 is formed from a copper material or an aluminium material. The carrier substrate 2 is preferably provided in a quasi-continuous process, preferably moving in the direction of the longitudinal extension X. It is also possible that the carrier substrate 2 is provided individually as a rod-shaped component.

Figure 1A:
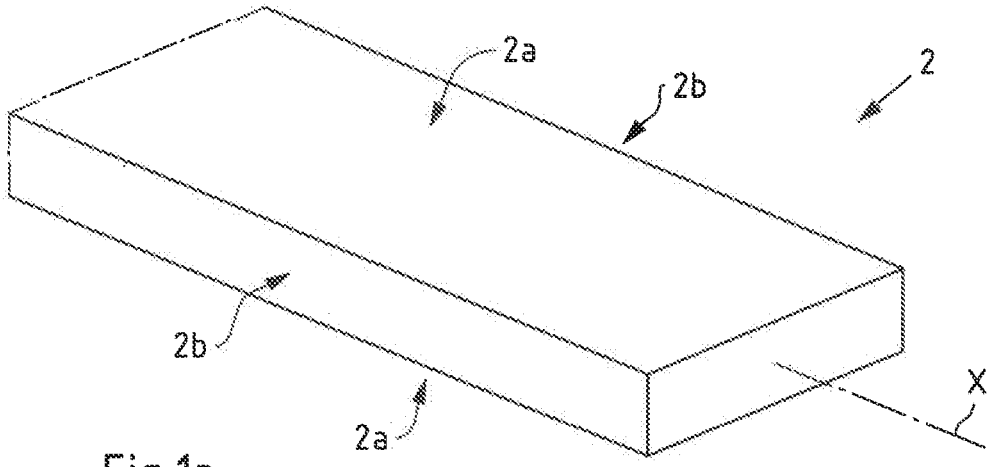
FIG. 1*a-d* the coating of a contact part according to embodiments.
Figure 1B:
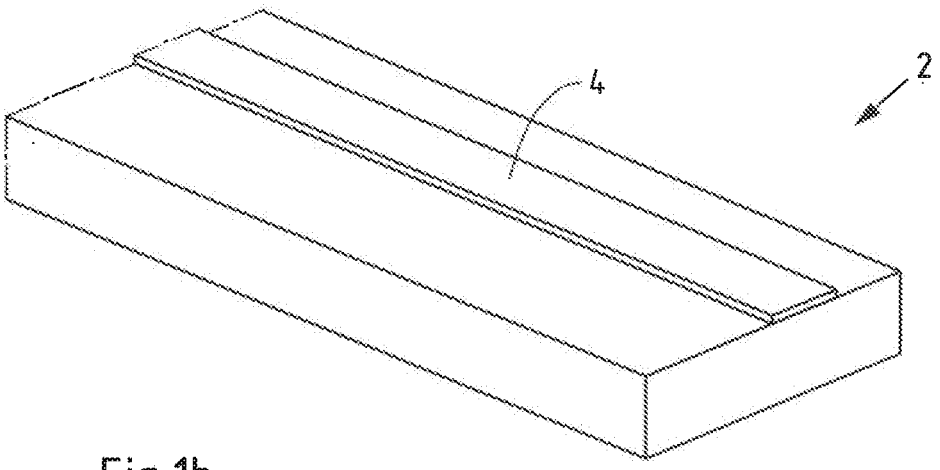

In a subsequent step, as shown in FIG. 1*b*, a coating barrier material 4 is applied to the carrier substrate 2 on at least one broad surface 2*a*. The partial area to which the coating barrier material 4 is applied preferably also extends along the longitudinal extent X of the carrier substrate 2. On the wide surface 2*a*, the coating barrier material 4 extends in a width extent in the range between 10% and 70% of the width extent of the wide surface 2*a*.

The coating barrier material 4 is preferably applied to the wide surface 2*a* in liquid or paste form in a preferably quasi-continuous process.

After the carrier substrate 2 has been coated with the coating barrier material 4, a metallic coating of the carrier substrate is carried out. The result of the metallic coating can be seen in FIG. 1*c*. The metallic coating 6 is applied circumferentially to the carrier substrate 2. Here, in particular, a wet-chemical coating process, for example an electroplating process, can be carried out. In this coating process, a metallic material 6 is deposited on the surface of the carrier substrate 2. This may be, for example, tin, zinc, nickel or the like.

The coating barrier material 4 prevents the metallic coating 6 from being deposited in the partial area in which the coating barrier material 4 rests on the carrier substrate 2. This can be achieved, for example, by the coating barrier material 4 being formed from a hydrophobic material. Thus, in the wet chemical process, the coating material 6 cannot be deposited on the surface of the carrier substrate 2 to which the coating barrier material 4 is applied.

After coating, the carrier substrate 2 is present coated with a coating material 6, wherein in the area of the coating barrier material 4 this coating material 6 is not applied. After coating with the coating material 6, the carrier substrate 2 is singulated so that singulated contact parts 8 are formed, as shown in FIG. 1*d*. Here, a contact part 8 can be produced from the carrier substrate 2 by means of cutting or punching. In addition to cutting the contact part 8 out of the carrier substrate 2, it can be shaped so that the contact part 8 is formed as a cable lug, terminal lug, terminal lug, crimp cable lug or the like.

Figure 2A:
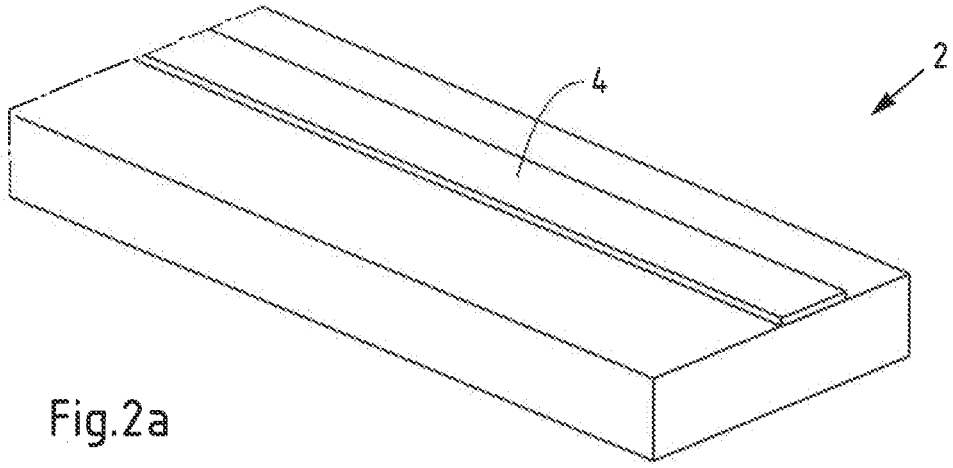
FIG. 2*a-c* the coating of a contact part according to embodiments.
Figure 2B:
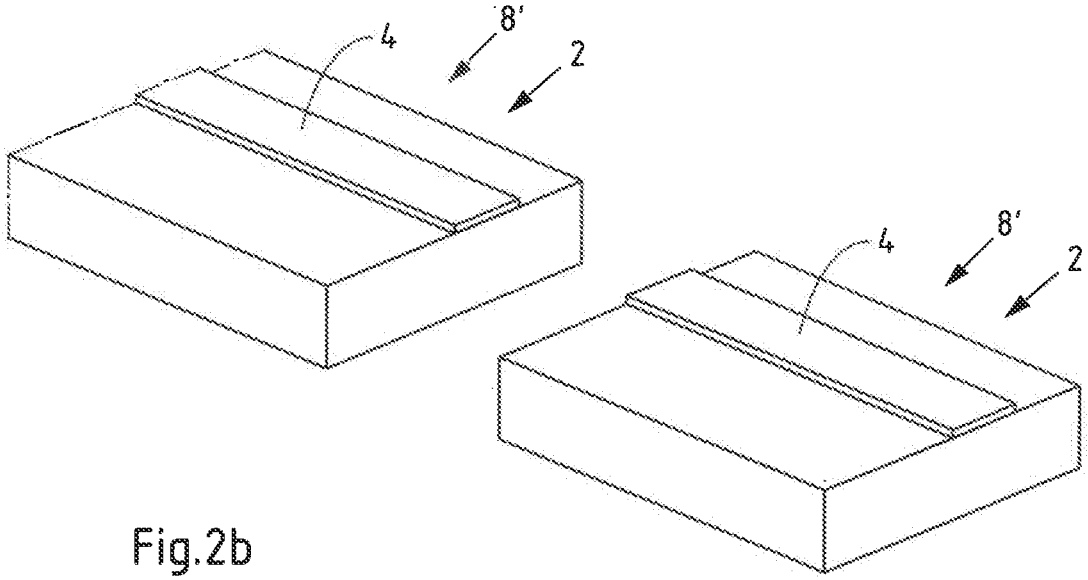
Figure 2C:
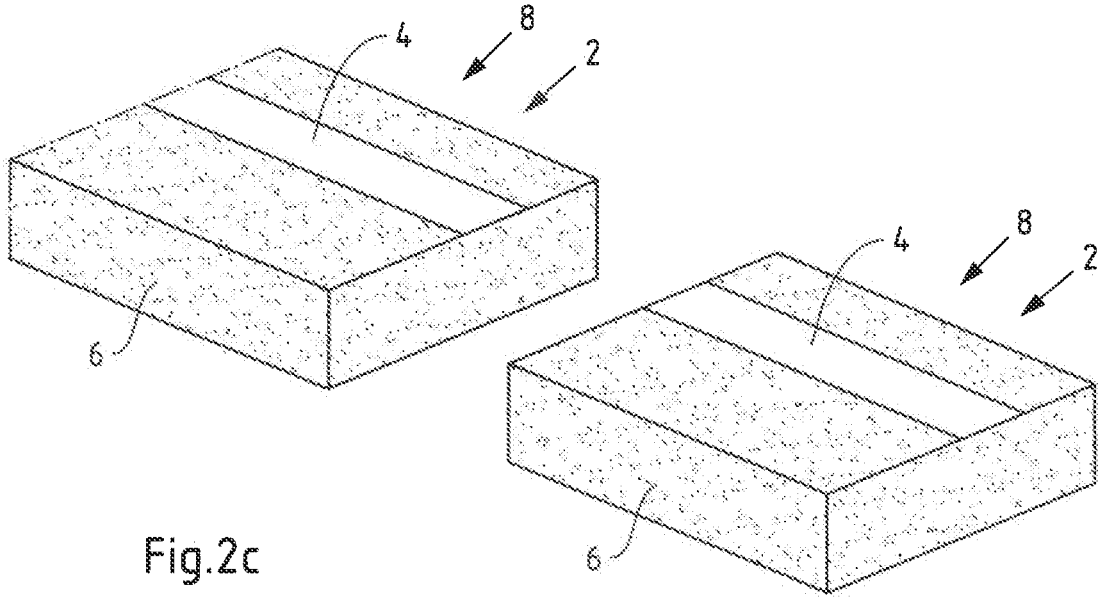

Another way of manufacturing contact parts 8 is shown in FIGS. 2*a-c*. In FIG. 2*a*, the carrier substrate 2 is shown after coating with the coating barrier material 4 according to FIG. 1*b*.

Before coating with the coating material 6, the carrier substrate 2 is separated and precursors 8' of the contact parts 8 are manufactured. Here, the singulation can be carried out according to the explanations for FIG. 1*c*. The precursors 8' are present, for example, as bulk material as shown in FIG. 2*b*. On the respective precursors 8', the carrier substrate 2 is coated in each case with the coating barrier tool 4.

Figure 1C:
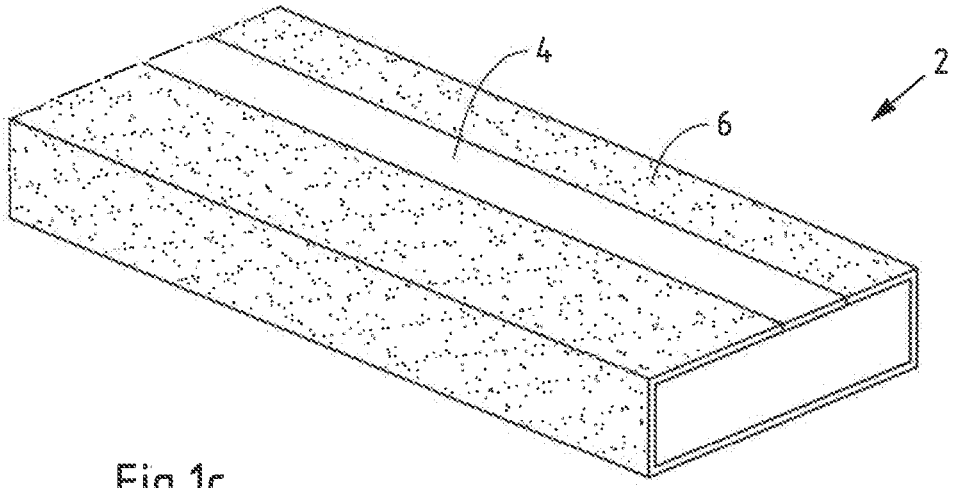
Figure 1D:
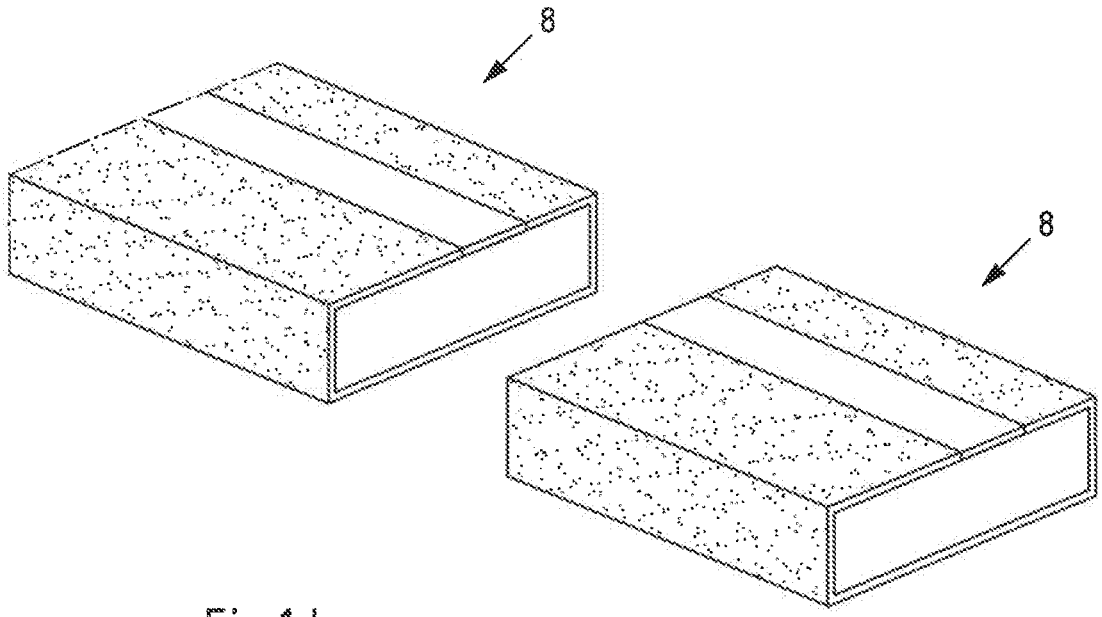

The precursors 8' are fed to a coating process, which can be carried out in accordance with the coating according to FIG. 1*c*. As a result of the fact that the precursors 8' are already singled, a completely circumferential coating with the coating material 6 is achieved, whereby also the cut edges which arise during singling of the carrier substrate 2 into the precursors 8' are coated with the coating material 6. Here, too, the carrier substrate 2 remains free of the coating material 6 in the area of the coating barrier material 4.

Figure 3A:
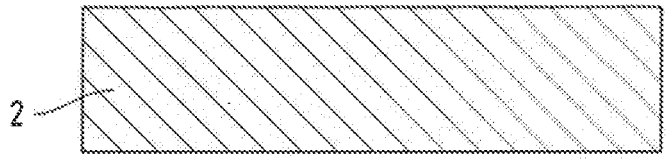
FIG. 3*a-e* the manufacturing of a connection between a contact part and a conductor according to embodiments.

FIGS. 3*a-e* show a cross-section perpendicular to the longitudinal axis X of the carrier substrate 2. In FIG. 3*a*, it can be seen that the carrier substrate 2 has a rectangular cross-sectional profile. It should be noted that any cross-sectional profiles of carrier substrate 2 are useful and conceivable. In particular, such cross-sectional profiles are useful which have at least one straight extending edge.

Figure 3B:
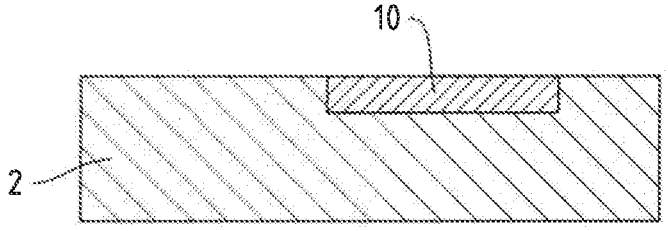

Preferably on the surface of the carrier substrate 2 formed by the straight edge and the longitudinal axis, a metallic inlay 10 is applied as shown in FIG. 3*b*. The inlay 10 can be provided as a sheet or strip, in particular in foil form. The inlay 10 can also be applied to the carrier substrate 2 by friction welding. The inlay 10 is made of a metallic material, which is in particular different from the metallic material of the carrier substrate 2. The material combination of aluminium and copper is preferred here, whereby alloys of these metals can be meant in each case.

At the transition between the inlay 10 and the carrier substrate 2, increased contact corrosion is to be fearexpected, so that this transition must be protected. On the other hand, the inlay 10 is to be used to contact the contact part 8 with a component and thus the bare metal of the inlay 10 should be available at the inlay 10.

Figure 3C:
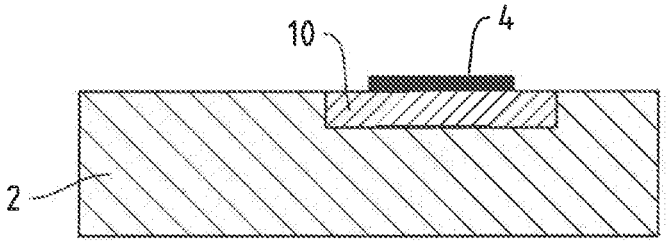

To achieve this, it is proposed that along the longitudinal extension of the inlay 10 in a width extension smaller than the inlay 10 and spaced apart from a transition between the inlay 10 and the supporting substrate 2, the coating barrier material 4 is applied, as shown in FIG. 3*c*. The coating barrier material 4 may be according to the above embodiments and, in particular, may be applied by means of a nozzle.

Figure 3D:
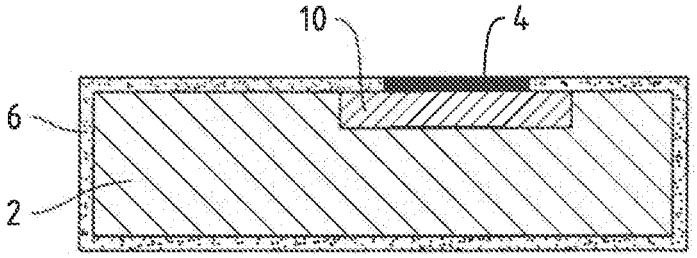

After the coating barrier material 4 is applied, the metallic coating 6 is applied to the carrier substrate 2 according to FIG. 1*c* or 2*c*, as shown in FIG. 3*d*. A central region of the inlay 10, where the coating barrier material 4 has been applied, remains free of the coating material 6.

Subsequently, the coating barrier material 4 can be removed by suitable methods, such as laser cleaning. Also, the coating barrier material 4 can be washed out, for example in an alcoholic solution.

After the coating barrier material 4 has been removed, or through the coating barrier material 4, an electrical conductor 12 can be secured to the inlay 10 by a material bond. This can be done, for example, by friction welding, ultrasonic welding, resistance welding, or the like.

Figure 3E:
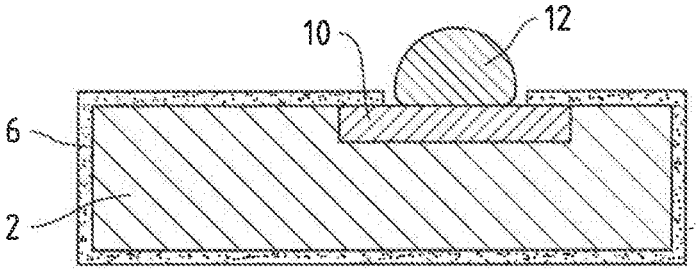

The connection of the conductor 12 to the bare metal of the inlay 10 is shown in FIG. 3*e*. For example, if the conductor 12 is made of aluminium material, the inlay 10 may be formed of aluminium material. If the conductor 12 is made of a copper material, the inlay 10 may be formed of a copper material. In this case, the carrier substrate 2 is different from the material of the inlay 10, for example in the first case from a copper material, in the second case from an aluminium material.

Figure 4:
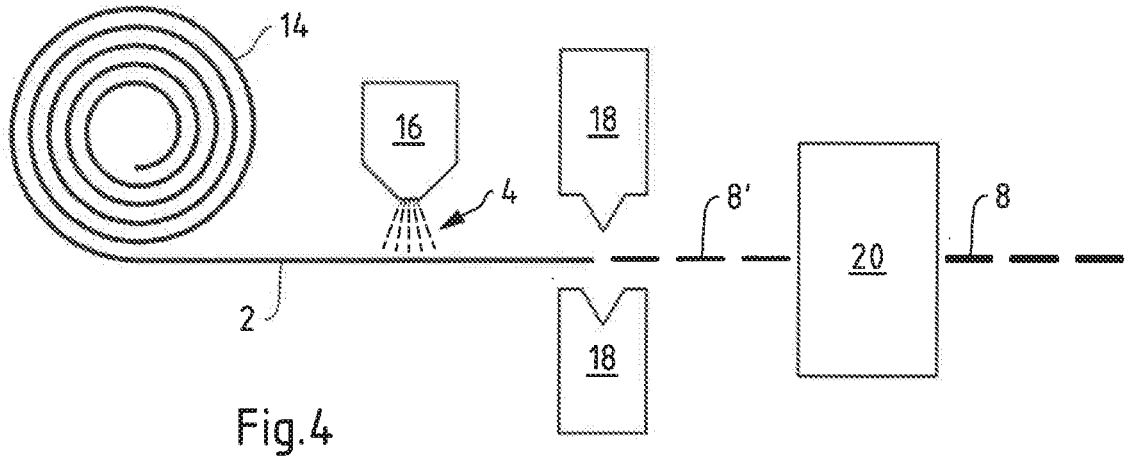
FIG. 4 a schematic view of a tool for coating a contact part.

FIG. 4 shows how the carrier substrate 2 is unwound from a coil 14 and continuously fed to a coating device 16. The carrier substrate 2 is moved along its longitudinal axis X past the coating device 16. Here, as shown in FIGS. 1*b* and 2*a*, a coating barrier material 4 is applied, for example sprayed, to the wide surface 2*a* of the carrier substrate 2.

Subsequently, the carrier substrate 2 is fed to a punch 18. The punch 18 punches out the precursors 8' from the carrier substrate 2. The punched precursors 8' are fed to a wet-chemical coating process 20, where they are coated with the metallic coating 6 so that the contact parts 8 are formed as shown in FIG. 2*c*.

Due to the coating barrier material 4, the carrier substrate 2 is free of the coating material 6 in a certain area of its broad surface 2*a*. This can be used not only to make a pure connection between an electrical conductor 12 and the carrier substrate 2 via an inlay 10, as shown in FIG. 3*e*, but also to increase the service life of a welding tool, for example an anvil of an ultrasonic welding tool.

Figure 5A:
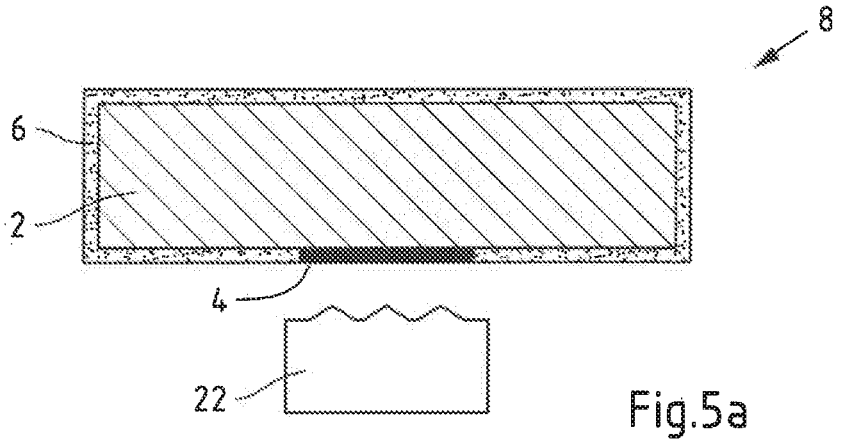
FIG. 5*a* the arrangement of a contact part on an anvil according to embodiments.

In known processes in which a coated component is welded, the coating material 6 lies directly against an anvil and leads to increased wear on the latter. For the present, the contact part 8 with the coating barrier material 4, in particular the surface of the carrier substrate 2 which is free of the coating material 6, can be placed on an anvil 22, as shown in FIG. 5*a*. The anvil 22 may have a relief-shaped surface to provide increased adhesion of the contact part 8 to the anvil 22. This relief-shaped surface allows the coating barrier 4 to be pierced so that, despite the coating barrier 4 still remaining, the anvil 22 comes into direct contact with the carrier substrate 2. This is shown in FIG. 5*a*, in which the contact part 8 is brought to the surface of the anvil 22.

Figure 5B:
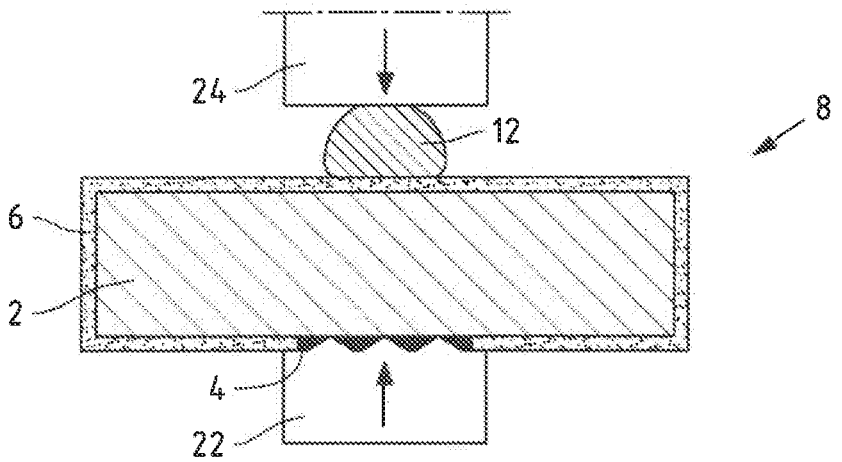
FIG. 5*b* the ultrasonic welding of a contact part to a conductor according to embodiments.

As shown in FIG. 5*b*, the anvil 22 with its relief-shaped surface has penetrated the coating barrier tool 4 and is in contact with the pure material of the carrier substrate 2. An electrical conductor 12 can be applied to the coating material 6 on the opposite side, and a sonotrode 24 can be used to weld the conductor 12 to the contact part 8 in the area of the metallic coating 6. The vibration introduced causes the conductor 12 to be welded to the coating material 6. As a result of the anvil 22 not coming into contact with the coating material 6, its service life can be increased.

LIST OF REFERENCE SIGNS

2 carrier substrate
4 coating barrier material
6 coating material
X longitudinal axis
8 contact part
8' precursor
10 inlay
12 electrical conductor
14 coil
16 coating device
18 punch
20 coating device
22 anvil
24 horn

What is claimed is:

1. Method of manufacturing an electrical connection comprising:

providing a carrier substrate of a metallic material, wherein the carrier substrate has at least a first and a second surface and wherein the first surface and the second surface are located on opposing sides of the carrier substrate;

applying a coating comprising an electrically non-conductive barrier material on the first surface of the carrier substrate such that the coating barrier material covers only a partial area of the first surface;

coating the carrier substrate on the first surface and the second surface with a metallic coating material, wherein the coating barrier material substantially prevents coating of said carrier substrate with said applied metallic coating material in said partial area;

placing the carrier substrate with the partial area onto an anvil or a sonotrode of an ultrasonic welding tool, such that a relief-shaped surface of the anvil or the sonotrode abut the coating barrier material within said partial area; and materially bonding, with the ultrasonic welding tool, an electrical conductor to the second surface coated with the metallic coating material, the second surface facing away from the first surface.

2. Method according to claim 1, wherein the carrier substrate is coated in a connection area with a material which is thinner than the carrier substrate or wherein the carrier substrate is coated in a connection area with a sheet metal, strap or foil which is thinner than the carrier substrate, wherein the partial area lies within the connection area, and that the carrier substrate and parts of the connection area are coated with the metallic coating material.

3. Method according to claim 1, further comprising removing the coating barrier material after the metallic coating or removing the coating barrier material after the metallic coating by evaporation, or removing the coating barrier material after the metallic coating by evaporation using a radiation source.

4. Method according to claim 1, wherein after the metallic coating, a contact part cut or punched out of the carrier substrate.

5. Method according to claim 1, wherein the coating barrier material is continuously applied to the carrier material via a nozzle.

6. Method according to claim 1, wherein the coating barrier material is applied to the substrate in liquid or paste form.

7. Method according to claim 1, wherein applying a metallic coating material comprises wet-chemically metallically coating, or wherein applying a metallic coating material comprises electroplating the carrier substrate.

* * * * *